166-250 SR
FIP8011 OR 4,153,109

United States Patent [19]

Szescila

[11] 4,153,109

[45] May 8, 1979

[54] METHOD AND APPARATUS FOR ANCHORING WHIPSTOCKS IN WELL BORES

[75] Inventor: Andrew J. Szescila, Broussard, La.

[73] Assignee: Baker International Corporation, Los Angeles, Calif.

[21] Appl. No.: 792,251

[22] Filed: May 19, 1977

[51] Int. Cl.[2] ..... E21B 7/08; E21B 23/00; E21B 47/024

[52] U.S. Cl. ..... 166/250; 166/315; 166/117.6; 166/123

[58] Field of Search ..... 166/250, 315, 255, 117.6, 166/117.5, 120, 123, 217; 175/81

[56] References Cited

U.S. PATENT DOCUMENTS

| | | | |
|---|---|---|---|
| 2,105,722 | 1/1938 | Barrett et al. | 175/81 |
| 2,327,658 | 8/1943 | Miller | 166/255 |
| 2,647,584 | 8/1953 | Baker et al. | 166/217 |
| 2,691,507 | 10/1954 | Brown | 166/255 X |
| 2,844,357 | 7/1958 | Ring | 166/255 X |
| 2,953,350 | 9/1960 | Moore | 166/255 |
| 3,052,309 | 9/1962 | Eastman | 166/117.5 X |
| 3,115,935 | 12/1963 | Hooton | 166/117.6 |
| 3,122,213 | 2/1964 | Hawk | 166/255 X |
| 3,208,355 | 9/1965 | Baker et al. | 166/319 X |
| 3,908,759 | 9/1975 | Cagle et al. | 166/117.6 |

*Primary Examiner*—Stephen J. Novosad
*Attorney, Agent, or Firm*—Subkow and Kriegel

[57] ABSTRACT

A packer having an orienting device is lowered in a well bore to a desired location and turned, if necessary, to point the orienting device in a selected direction, after which the packer is anchored against movement in the well bore. A whipstock, anchor and orienting mandrel are secured together in such manner that an orienting device on the mandrel, companion to the packer orienting device, is aligned with the whipstock. The whipstock, anchor and mandrel combination is then lowered in the well bore, the mandrel orienting device engaging the packer orienting device, effecting turning of the combination to point the whipstock in the same final direction as the packer orienting device, whereupon the anchor is secured to the packer to prevent movement of the whipstock from its final oriented position, which is the direction that a suitable cutting tool is to be deflected by the whipstock to cut a window in a well casing in the well bore, to sidetrack the well bore, or to perform both of these operations.

20 Claims, 12 Drawing Figures

METHOD AND APPARATUS FOR ANCHORING WHIPSTOCKS IN WELL BORES

Figure 1A:
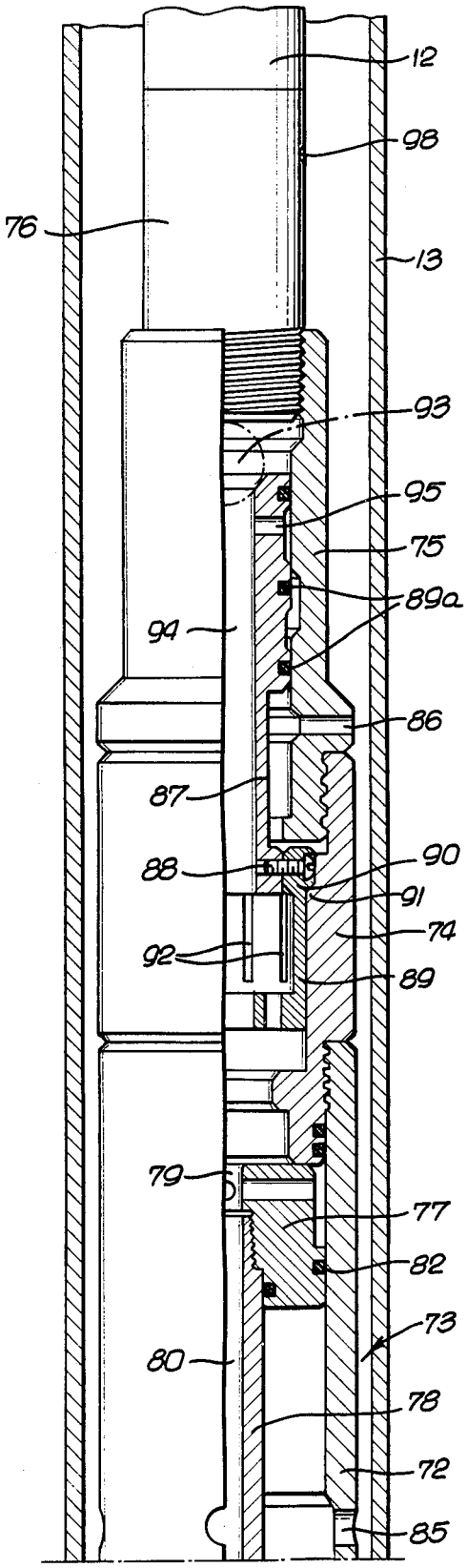

The present invention relates to well bore apparatus, and more particularly to whipstock apparatus anchored in the well bore to deflect one or more cutting tools, for the purpose of cutting a window in casing, sidetracking the well bore, or cutting the window and also sidetracking the well bore.

In sidetracking a well bore, a cement plug or a bridge plug has heretofore been set in the well bore and a permanent whipstock set against the particular plug installed in the well bore. Reliance has been placed upon a slip to anchor the whipstock in position by applying drilling string weight to the latter. This arrangement is not dependable since the whipstock occasionally is lifted or turned by the drill string used in sidetracking the well bore. It becomes impossible to reenter the sidetracked hole with the drill string, since the whipstock has been inadvertently shifted to a position in which it is no longer oriented with the sidetracked hole.

An object of the present invention is to anchor a whipstock to a bridge plug or packer set in the well bore to prevent turning, or other shifting, of the whipstock in the bore.

A further object of the invention is to provide a whipstock anchored to a bridge plug or packer, the whipstock coacting with the plug or packer to point in the particular direction which is the direction in which a window is to be cut in the casing and the well bore sidetracked, or in which the well bore is to be sidetracked only in the event the casing has been previously cut away by a casing mill.

In general, a packer or anchor containing an orienting device is connected to a drill pipe, or other tubular string, that has an orienting sub located above the packer and aligned rotationally with the orienting device of the packer. After the apparatus has been lowered to the depth in the well bore at which it is to be set, a survey is taken, as by lowering a survey instrument through the drill pipe into the orienting sub, or in any other known manner, to determine the direction in which the orienting device is pointed. The drilling string is then turned a sufficient number of degrees to shift the orienting device arcuately so that it points in the direction in which the window is to be subsequently cut by a suitable casing mill, or the hole sidetracked. The lower end of a whipstock is then secured to a suitable anchor device, and its tapered face or deflecting surface aligned with an orienting device of a mandrel which is to be moved within the packer and into engagement with the orienting device of the packer, which will automatically turn the mandrel and whipstock and secure it in a position in which the whipstock is oriented with the device of the packer. The whipstock is then anchored to the packer to prevent its subsequent turning from the desired direction to which it has been oriented and to prevent its release from the packer.

In the event that the orientation of the whipstock is not necessary, the packer can still be run and set on a tubular string, or on a wireline, after which the whipstock can be run in the well bore and suitably secured against subsequent turning by the packer.

This invention posseses many other advantages, and has other purposes which may be made more clearly apparent from a consideration of a form in which it may be embodied and the method of employing such form.

This form is shown in the drawings accompanying and forming part of the present specification. It will now be described in detail, for the purpose of illustrating the general principles of the invention; but it is to be understood that such detailed description is not to be taken in a limiting sense.

Figure 1B:
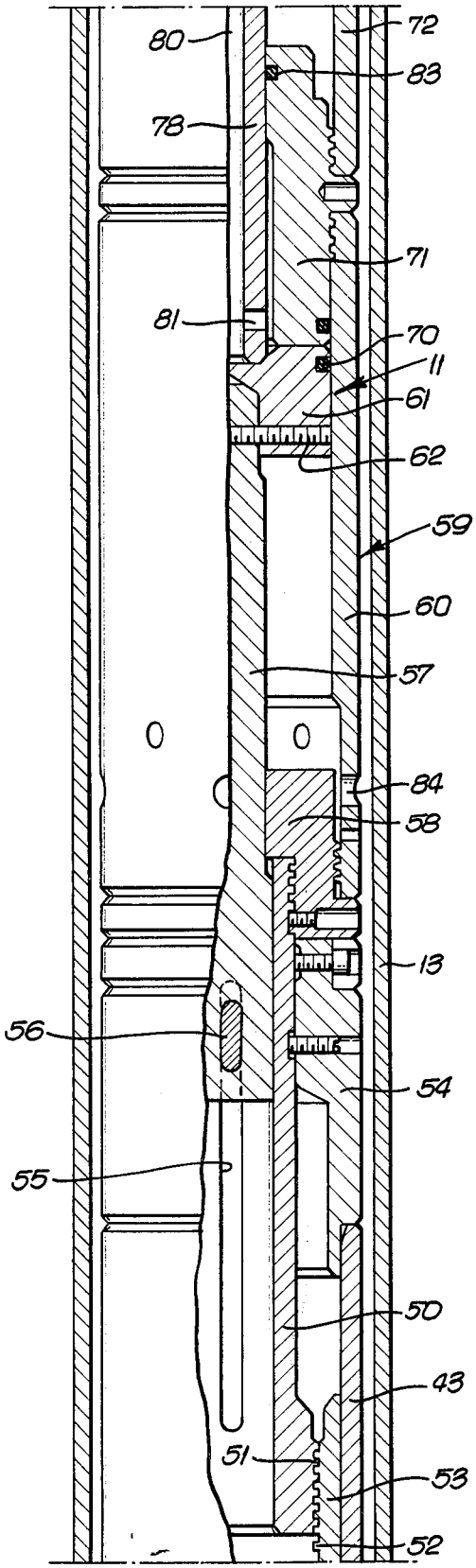
Figure 1C:
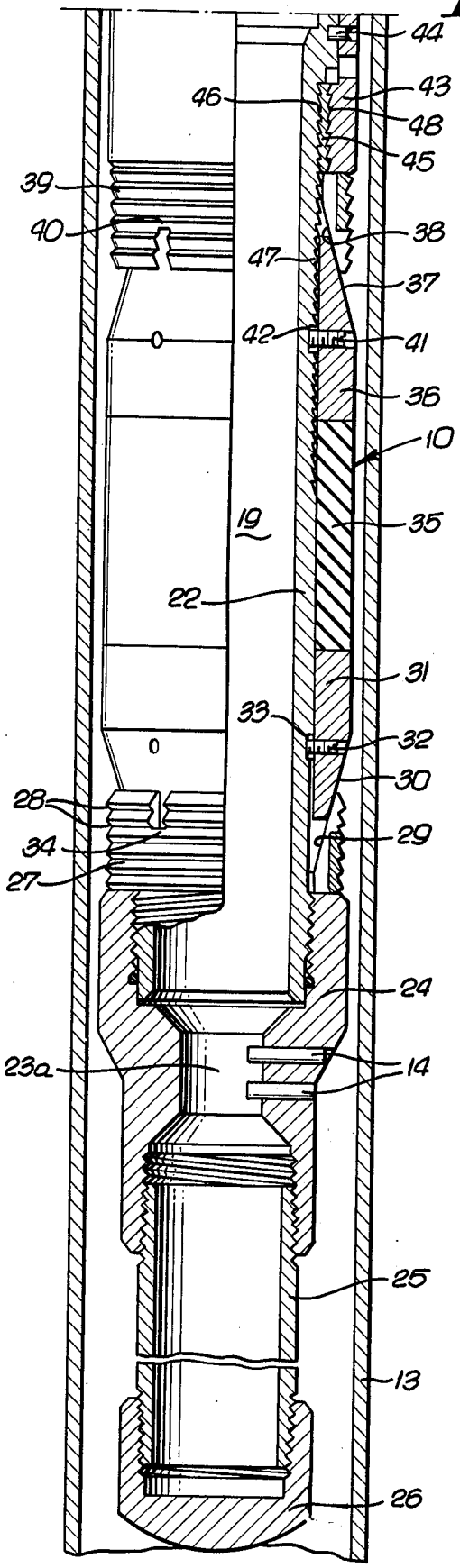
Figure 2:
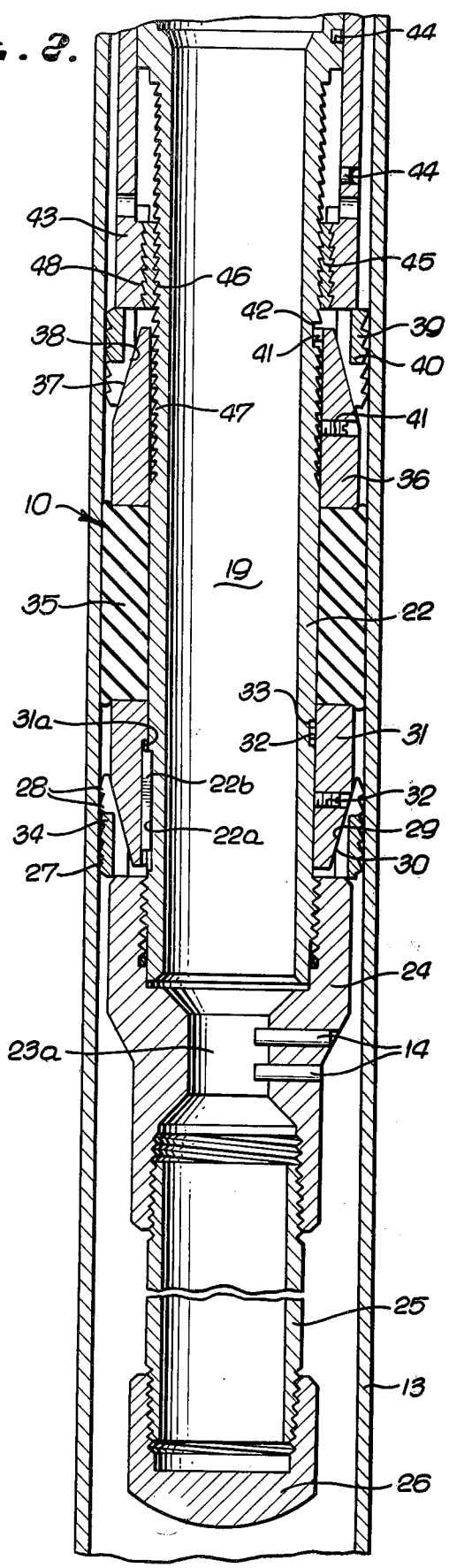
Figure 3A:
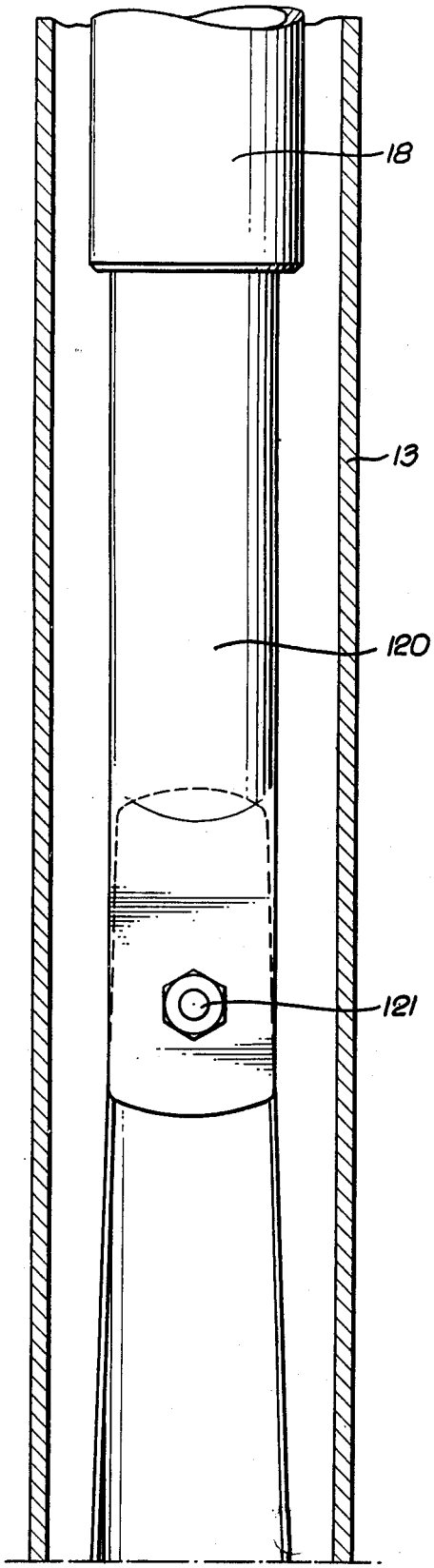
Figure 3B:
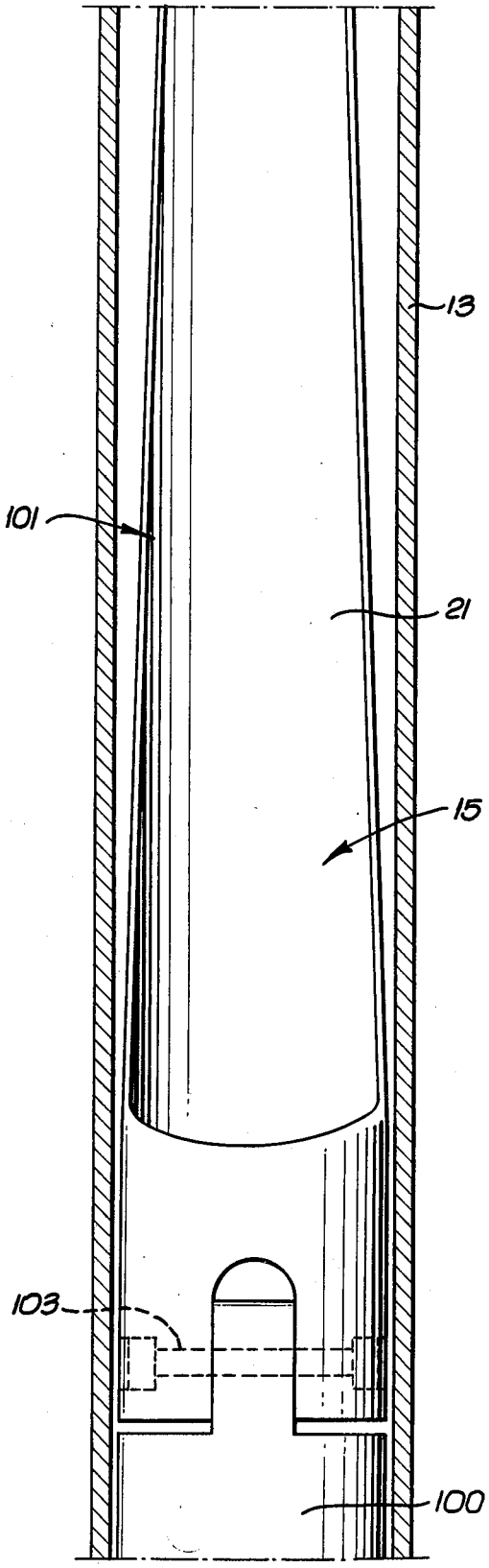
Figure 3C:
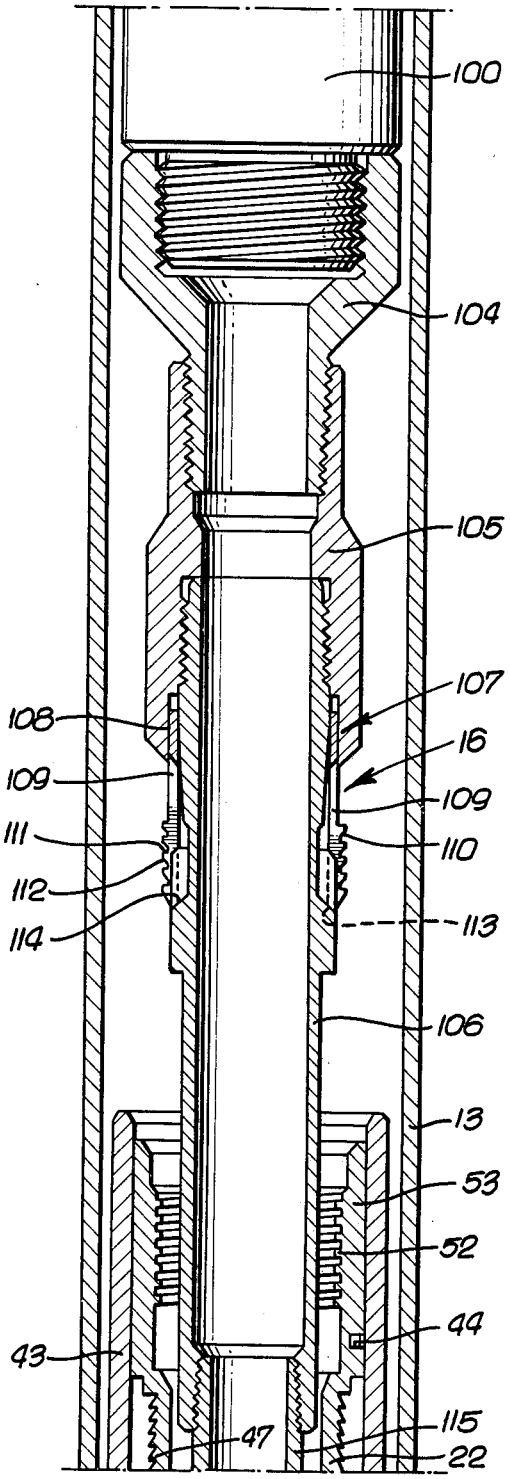
Figure 3D:
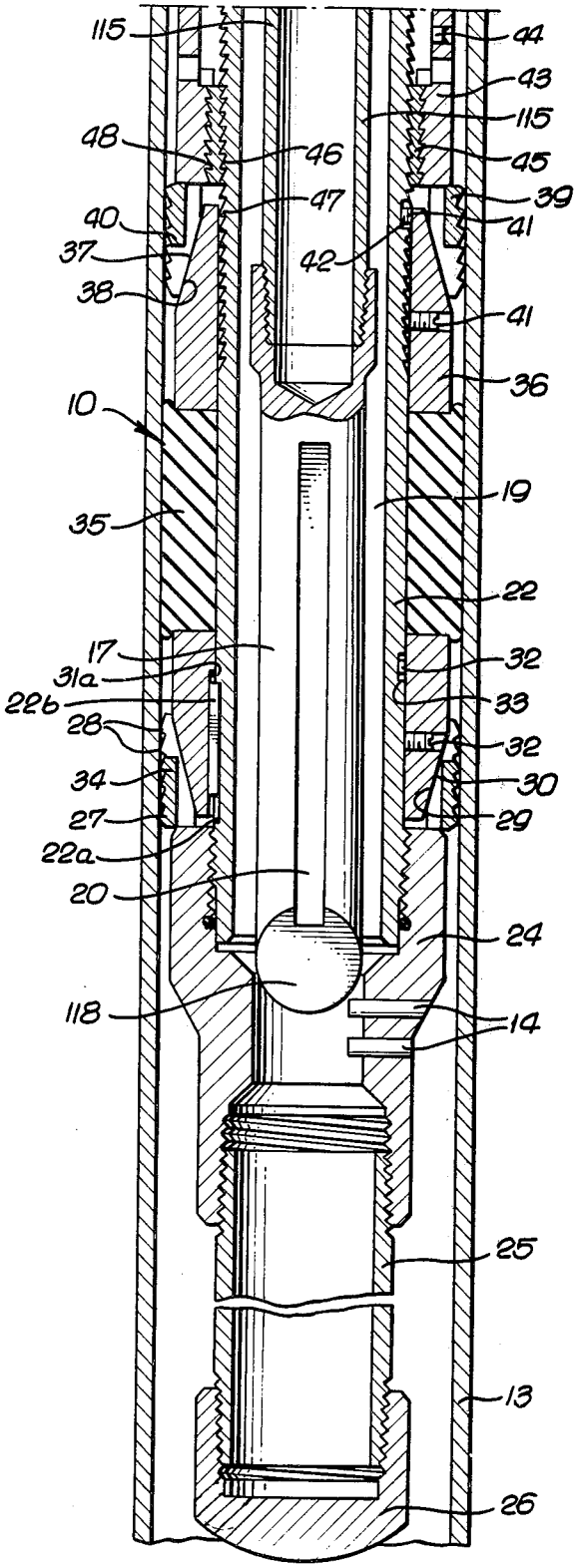
Figure 4A:
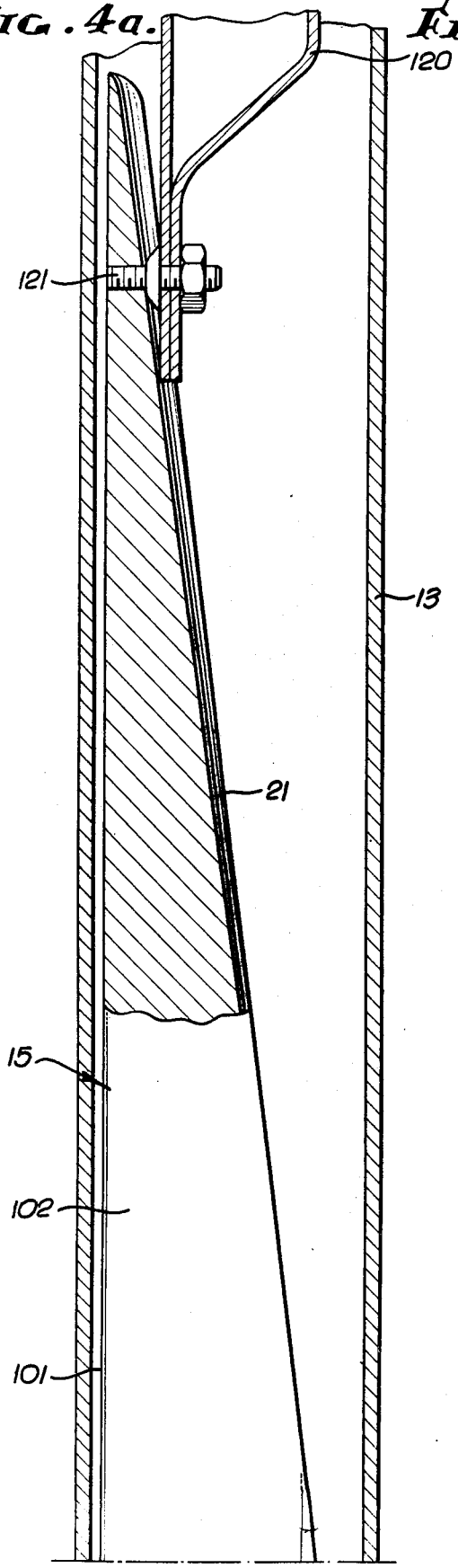
Figure 4B:
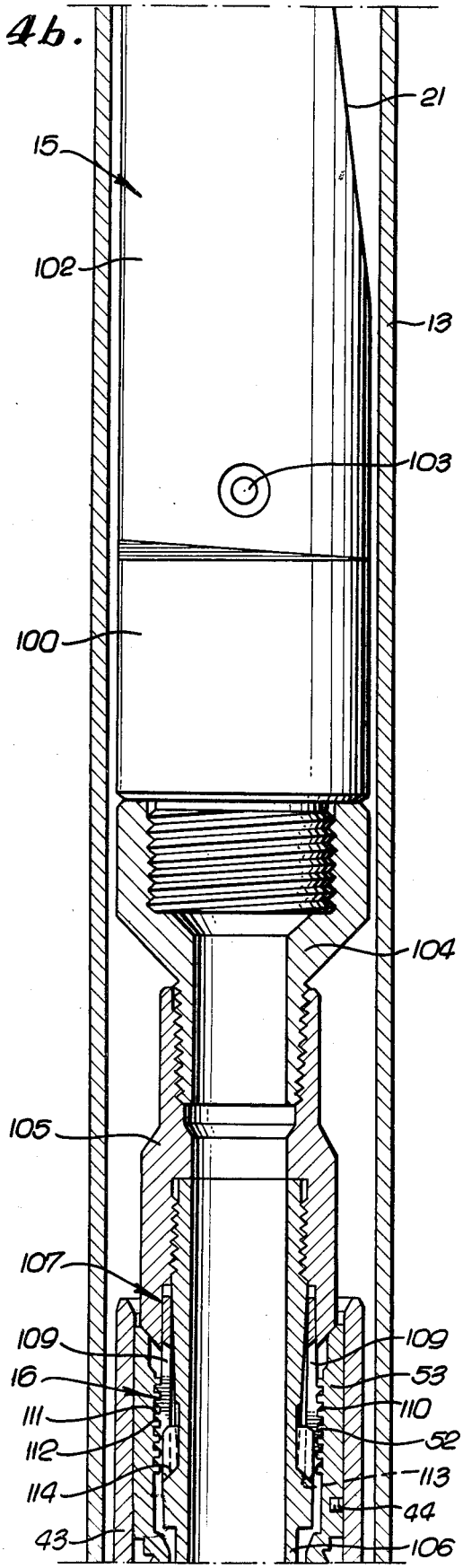
Figure 4C:
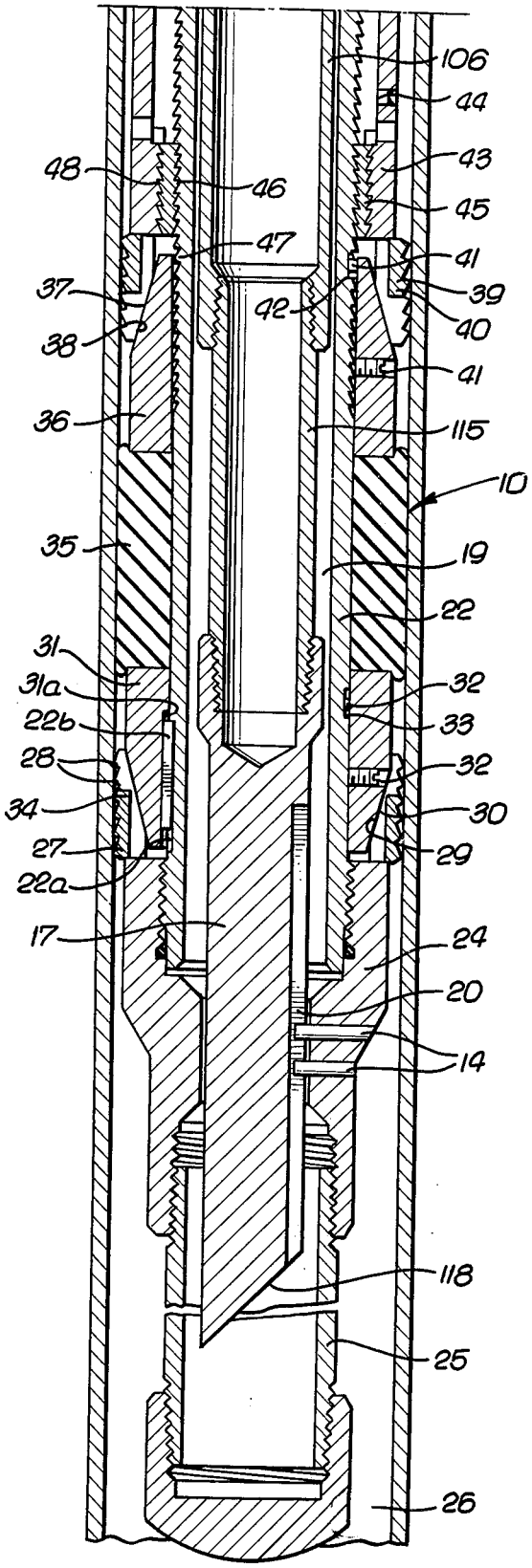
Figure 5:
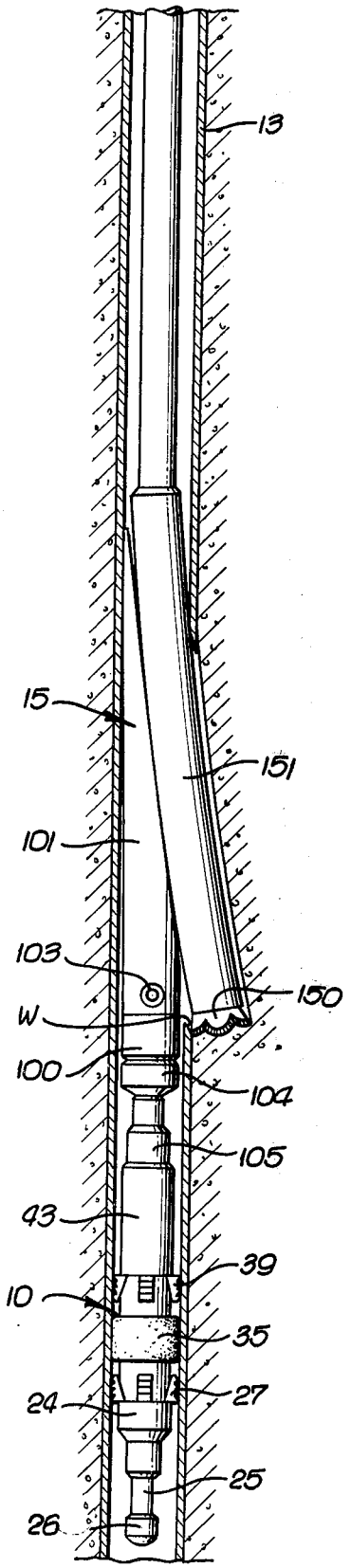

Referring to the drawings:

FIGS. 1*a*, 1*b*, and 1*c* together constitute a combined side elevational view and longitudinal section through a well packer, bridge plug apparatus, or anchor, and a setting tool therefore located in well casing, FIGS. 1*b* and 1*c* being lower continuations of FIGS. 1*a* and 1*b*, respectively;

FIG. 2 is a longitudinal section illustrating the well packer anchored in packed-off condition in the well casing;

FIGS. 3*a*, 3*b*, 3*c*, and 3*d* together constitute a combined side elevational view and longitudinal section through a well packer and whipstock combination, with the parts shown in one relative position, FIGS. 3*b*, 3*c*, and 3*d* being lower continuations of FIGS. 3*a*, 3*b*, and 3*c*, respectively;

FIGS. 4*a*, 4*b*, 4*c* together constitute a combined longitudinal section and side elevational view through the apparatus of FIG. 3, disclosing the whipstock in its final oriented position with respect to the well packer, FIGS. 4*b* and 4*c* being lower continuation of FIGS. 4*a* and 4*b*, respectively; and FIG. 5 is a somewhat diagrammatic view of a milling tool being deflected laterally by the whipstock and having cut a window in well casing through which the bore hole is to be sidetracked.

As disclosed in FIGS. 1*a*, 1*b*, and 1*c*, a well packer, bridge plug, or anchor 10 is secured to a suitable setting tool 11 and this combination run on a tubular string 12 to a desired depth in a well casing 13 disposed in a well bore. The tubular running string 12, setting tool 11, and packer 10 are then turned to the requred extent to point an orienting device 14 (FIG. 1*c*) in the well packer in a required direction. The setting tool is then suitably operated to anchor the packer in the well casing (FIG. 2). The setting tool 11 and running string 12 are then disconnected from the packer and removed from the hole. A whipstock 15, secured to an anchoring device 16 and to an orienting and locking mandrel 17, are then lowered on a tubular string 18 in the casing 13 until the mandrel 17 is located within the passage 19 of the well packer, the parts then occupying the positions illustrated in FIGS. 3*a*, 3*b*, 3*c*, and 3*d*. Continuing lowering of the whipstock, anchor, and mandrel shifts an orienting portion 20 of the mandrel into an appropriate relation to the packer orienting device 14, so that the concave face 21 of the whipstock faces in the required direction, which is the same direction in which the packer orienting device 14 is located or pointing, the parts then being in the position illustrated in FIGS. 4*a*, 4*b*, and 4*c*.

As disclosed in FIGS. 1*a*, 1*b*, 1*c*, the apparatus includes the well packer or bridge plug 10 which has a central body 22 provided with the longitudinal passage 19 extending therethrough. A guide 24 is threadedly secured to the lower end of the body 22 and has one or more radial orienting pins 14 secured thereto projecting into the guide passage 23*a* to a short extent. This guide, in turn, is threaded onto the upper end of a pup joint 25, the lower end of which is threaded into a bull plug 26 which effectively closes the lower end of the passage 19 through the packer.

A lower clip structure 27 surrounds the body, engaging the upper end of the body guide 24. This slip structure has external teeth 28 which are to be engaged with the well casing and an internal expander surface 29 which tapers in an inward and downward direction, this tapered surface, in turn, engaging a companion externally tapered surface 30 on a lower expander 31 initially secured to the body 22 of the tool by one or more shear screws 32 threaded in the expander and received within a peripheral groove 33 in the body. The body is prevented from rotating relative to the expander 31 by a key 22*b* fixed in a body groove 22*a* and slidably fitting in an expander groove 31*a*. The slip structure has circumferentially spaced weakened sections 34 therein so that the relative downward shifting of the lower expander 31 within the slip structure causes the latter to break at the weakened sections into a plurality of slip elements, which are then expanded outwardly into anchoring engagement with the well casing. The upper end of the lower expander 31 bears against a packing 35 surrounding the body, the upper end of which bears against the lower end of an upper expander 36 having a tapered surface 37 inclined in an upward and inward direction. This tapered surface engages a companion internal tapered surface 38 in an upper slip ring 39 which also has weakened sections 40, so as to break into slip segments upon relative upward wedging of the upper expander 36 within the slip structure or ring, the segments then shifting outwardly into anchoring engagement with the wall of the well casing. Initially, the upper expander 36 is releasably secured to the body 22 by one or a plurality of shear screws 41 threaded in the expander and received within a peripheral body groove 42.

The lower end of a setting sleeve 43 engages the upper end of the slip device 39, the setting sleeve being initially held in an upward position along the body by suitable shear pins 44. A split body lock ring 45 is disposed between the lower portion of the setting sleeve and the body, this ring having upwardly facing inner ratchet teeth 46 adapted to cooperate with external ratchet teeth 47 on the body, for the purpose of permitting the setting sleeve 43 to shift relatively downwardly along the body 22, but preventing return upward movement of the setting sleeve with respect to the body. The lock ring 45 can expand outwardly sufficiently to permit it to move downwardly along the body ratchet teeth. However, any tendency for the setting sleeve to move upwardly will cause cam teeth 48 in the setting sleeve to engage companion cam teeth in the lock ring to urge the latter inwardly and retain its ratchet teeth fully meshed with the body ratchet teeth. The details of the body lock ring and ratchet arrangement are unnecessary to an understanding of the present invention. Such details are fully described in the U.S. Pat. No. 2,647,584.

As disclosed in the drawings, a setting assembly 11 is connected to the upper end of the body 22 for the purpose of setting the upper and lower slips 39, 27 against the casing and expanding the packing 35 into sealing engagement with the casing wall and the packer body itself. This setting assembly, per se, forms no part of the present invention being based upon the disclosure in U.S. Pat. No. 3,208,355, to which attention is invited. As shown in the present drawings, a setting mandrel 50 has its lower end provided with a left-hand thread 51 meshing with companion internal threads 52 in the box 53 of the packer body 22. A setting sleeve 54 is slidably mounted on the setting mandrel, which has a pair of diametrically opposed longitudinally extending slots 55 through which a cross-over piece or anvil 56 extends which is connected to the setting sleeve 54 and which passes through the lower end of a piston rod 57 extending upwardly through a lower cylinder head 58 of a lower cylinder 59. The setting sleeve 54 engages the upper end of the packer setting sleeve 43 when the setting mandrel 50 has been threadedly connected to the box 53.

The lower cylinder head 58 is threadedly secured to the upper end of the setting mandrel 50 and also to the lower end of a lower cylinder sleeve 60. A lower piston 61 is piloted over and attached to the upper end of the piston rod 57, as through use of a set screw 62, and is slidable in the lower cylinder sleeve 60. Its relative downward movement in the lower cylinder sleeve 60 moves the lower piston rod downwardly, exerting a downward force on the setting sleeve 54. Reactively, the cylinder 59 moves in an upward direction to pull the setting mandrel 50 upwardly which is releasably connected to the body 22 of the well packer or bridge plug by the left-hand threads 51, 52. With the setting sleeve 54 exerting a downward force on the packer setting sleeve 43 and the mandrel 50 an upward force on the packer body 22, the setting sleeve pin 44 is first disrupted, the sleeve shifting relatively downwardly along the body to wedge the upper slip sleeve 39 downwardly of the upper expander 36 and break it at its weakened sections 40 into segments. When sufficient downward force has been exerted on the upper expander, its shear screws 41 are disrupted and the upper expander moves toward the lower expander 31 to compress the packing sleeve 35 between the expanders and expand it outwardly against the well casing. The upward force on the packer body 22 also causes the body guide 24 to urge the slip sleeve 27 and expander 31 upwardly to disrupt the shear screws 32 securing the lower expander to the body, whereupon the lower slip sleeve is disrupted at its weakened sections 34 to form segments which are expanded outwardly by the lower expander into anchoring engagement with the casing. The setting tool shifts the packer setting sleeve 43 downwardly along the body 22 and the body relatively upwardly until the upper and lower slip segments and the packing are firmly engaged with the wall of the well casing 13, the body lock ring 45 ratcheting downwardly along the body. The setting sleeve 43 cannot move upwardly because of the coengagement between the ratchet teeth 46, 47, thereby securng the slips and packing in their outward expanded condition, which will not only prevent longitudinal movement of the well packer or bridge plug in both directions but which will prevent its rotation.

The lower piston 61 has a side seal ring or piston ring 70 on its periphery adapted to slidably seal along the wall of the lower cylinder sleeve 60. The upper end of the lower cylinder sleeve 60 is threadedly attached to an intermediate cylinder head 71 which is, in turn, threadedly secured to the lower end of an upper cylinder sleeve 72 forming part of an upper cylinder 73. This upper cylinder is threadedly secured to an upper control sub 74 threadedly connected to an upper sub 75 for securement to an orienting sub 76 attached to the tubular string 12 extending to the top of the well bore.

Disposed in the upper cylinder below its upper head, is an upper piston 77 threadedly, or otherwise suitably secured, to a tubular thrust rod or upper piston rod 78 that extends downwardly through the upper cylinder sleeve 72 and through the central bore in the intermediate head 71, the lower end of the tubular rod engaging the upper end of the lower piston 61. The upper end of the upper piston has an inlet port 79 for allowing fluid under pressure to pass downwardly through the central passage 80 in the upper piston rod, such fluid then passing outwardly through an outlet port 81 in the lower portion of the tubular rod into the lower cylinder 59. Leakage of fluid around the upper piston is prevented by a suitable piston ring 82 mounted in its peripheral portion and slidably sealing against the wall of the upper cylinder sleeve 72. Similarly, rod packing 83 is mounted in the intermediate cylinder head 71 which is adapted to slidably seal against the upper piston or thrust rod 78.

The lower cylinder sleeve 60 has suitable bleeder ports 84 therethrough to permit the fluid in the well bore externally of the apparatus to enter the lower cylinder below the lower piston 61. Similarly, bleeder ports 85 are provided in the upper cylinder sleeve 72 to allow fluid to pass into the upper cylinder below the upper piston 77. During lowering of the apparatus through the fluid in the well bore, such fluid can pass to the interior of the top sub 75 through a plurality of fill ports 86, fluid passing downwardly along a support sleeve 87 attached by shear screws 88 to the upper end of a control latch 89 having upper fingers 90 overlying a shoulder 91 in the control sub 74. The fluid can pass through the circumferentially spaced longitudinal slots 92 in the control latch into the interior of the control sub, then flowing upwardly through the tubular string 12 toward the top of the well bore.

When the well packer is to be set, as described hereinabove, a suitable trip ball 93 is dropped into the tubular string and will come to rest on the upper end of the support sleeve 87, closing the passage 94 through the latter. Fluid under pressure is then exerted on the fluid in the tubular string to disrupt the shear screws 88 and shift the support sleeve downwardly to a position in which the longitudinally spaced seal rings 89*a* on the support sleeve close off the fill ports 86, the support sleeve moving downwardly of the control latch 89 and releasing its fingers 90 from the shoulder 91. The fluid can then flow around the upper portion of the support sleeve 87 and in through ports 95 therein to the interior passage 94 of the support sleeve, and then act downwardly on the upper piston 77 and simultaneously on the lower piston 61 to shift the setting sleeve 54 downwardly, the cross-piece 56 moving downwardly in the mandrel slots 55 enabling the setting sleeve 54 to exert a downward force on the packer setting sleeve 43. As stated above, the pressure in the setting tool exerts an upward force on the cylinder mechanism 73, 59 and an upward pull on the setting mandrel 50 and packer body 22 attached thereto, to set the well packer in the manner above described.

Further details of construction of the hydraulic setting assembly 11 with respect to its tandem cylinder and piston arrangement, and the cross-over anvil, slotted mandrel, and setting sleeve will be found in U.S. Pat. No. 3,208,355.

The orienting sub 76 for a gyroscopic single shot survey instrument (not shown) is secured to the top sub 75 and aligned rotationally with the orienting pins 14 in the packer body guide 24. This survey instrument is not illustrated since it is a known device, being disclosed on pages 1817 and 1818 of the 1974–75 Composite Catalog of Oil Field Equipment and Services. This orienting sub has an orienting pin 98 extending thereinto which is aligned with the packer body orienting pins. A survey instrument is lowered through the tubing string and a picture taken which will disclose the bearing of the pin 98, which the operator can read after removal from the tubing string to determine exactly how many degrees the orienting sub pin 98, and, therefore, the orienting packer pins 14, are removed from the desired direction. Prior to setting the well packer 10 in the well casing, the tubing string 12 is turned the appropriate number of degrees to point the orienting pins 14 in the direction in which the whipstock 15 is to face, whereupon the setting tool 11 is actuated to anchor the packer to the well casing against longitudinal movement and also against rotational movement.

After the packer has been set in the well casing the tubular string 12 and hydraulic setting assembly 11 are rotated to the right to unthread the setting mandrel 50 from the packer body box 53, the setting assembly then being withdrawn from the well bore.

The whipstock 15 (FIGS. 3*a*–3*d*) includes a lower anchor section 100 and an upper section 101 which has a partially cylindrical or convex exterior 102 and a concave tapered inner face 21. The lower end of the upper section is connected to the lower anchor section by means of a hinge pin 103. The anchor section 100 is threadedly secured to a connector 104 which is, in turn, threadedly attached to a top collar 105 threadedly secured to an anchor sub 106 having a latch sleeve 107 mounted thereon. The upper portion 108 of the latch sleeve is circumferentially continuous, the sleeve having a plurality of circumferentially spaced slots 109 opening through its lower end to provide resilient, outwardly expandable dogs 110 which are threaded. The upper side 111 of each of the threads is substantially normal to the axis of the sub, the lower side 112 of said thread being tapered in a downward and inward direction. The dogs can move downwardly along the anchor sub 106 to a limited extent because of engagement of the lower tapered ends 113 of the dogs with a companion tapered flange 114 of the anchor sub.

The details of construction of the anchor sub and its threaded latch are unnecessary to an understanding of the present invention, being illustrated and described in U.S. Pat. No. 2,737,248.

The anchor sub 106 has an extension 115 threadedly secured to its lower end, the lower end of this extension, in turn, being threadedly secured to an orienting and locking mandrel 17 having a longitudinal groove 20 therein. This mandrel terminates in a tapered face or mule-shoe portion 118, the upper tapered surface of which has the longitudinal groove 20 opening therethrough. This mule shoe is engageable with the orienting packer pins 114, when the mandrel 17 is lowered in the packer body passage 23, to effect a turning of the orienting mandrel 17 to place its groove 20 in alignment with the pins 14. When such alignment occurs, the mandrel 17 can continue its downward movement in the packer passage and along the orienting pins 14. As the mandrel 17 turns, the whipstock turns with it, so that the center line of the concave face 21 lies in the same plane and faces in the same direction as the longitudinal groove 20, when the pins 14 are disposed in the latter.

Prior to lowering the whipstock and the parts depending therefrom in the well bore, the whipstock is secured to a setting tool 120 by means of a setting stud 121, the setting tool being attached to a tubular string 18 for lowering the whipstock 101, latch and anchor portions 107, 106 and mandrel 17 into the casing, the lowering continuing until the lock mandrel 17 and anchor sub 106 enter the packer passage 23. The parts continue their downward movement, the mule shoe 118 engaging the orienting packer pins 14 and effecting turning of the entire whipstock assembly, latch, anchor sub, and orienting and locking mandrel until the longitudinal groove 20 is aligned with the orienting pins. When such alignment occurs, with downweight being maintained on the tools, the longitudinal groove portion 20 of the orienting mandrel slides along the pins, the parts continuing to move downwardly until the latch 107 enters the packer box 53, with the top collar 105 engaging the upper end of such box (FIG. 4*b*). At this time, the latch dogs 110 will have ratcheted past the box teeth 52, and will expand inherently outwardly to fully engage the dog threads 51 with the box threads, as shown in FIG. 4*b*. As disclosed in FIG. 4*c*, the orienting pins 14 are located well within the groove 20, engaging the sides of the groove to prevent any significant turning of the mandrel and the whipstock with respect to the anchor, bridge plug, or well packer 10. Any tendency for the whipstock 15, and the parts connected thereto, to move upwardly will cause the tapered expander surface 114 on the anchor 106 to engage the companion tapered surfaces on the dogs to shift and retain the latter outwardly in full threaded engagement with box threads. Thus, the whipstock is secured to the bridge plug or packer in a desired position, with the concave surface 21 of the whipstock oriented in the same direction as the orienting pins 14 of the well packer. A suitable upward pull taken on the tubing string will disrupt the setting stud 121 and permit the tubing string 18 and setting tool 120 to be removed from the well bore.

Once the whipstock is set and anchored in place, a milling operation can be initiated, in a known manner, through use of a suitable mill 150 attached to a drill string 151, the mill being deflected laterally by the concave surface 21 of the whipstock and in the predetermined direction, to cut a window W through the casing as a result of rotation of the drill string (FIG. 5).

The apparatus and method described above is also useful in connection with setting a whipstock after a casing mill has been used to cut away a desired length of casing in a known manner. The bridge plug or anchor is set in the casing below the removed casing section, and the hole sidetracked through use of a suitable tool, which is deflected in the desired direction by the whipstock.

I claim:

1. Apparatus for securing a whipstock in a well bore to face in a predetermined direction, comprising an anchor including a first directional device, means for determining the direction in which said device is pointing and the angular relation between said device and said predetermined direction, means for securing said anchor in the well bore with said directional device located in the same angular relation to said predetermined direction, a whipstock, anchor means secured to said whipstock, a mandrel operatively connected to said anchor means and having a second directional device bearing the same angular relation to said whipstock as said first directional device bears to said predetermined direction, said second directional device coacting with said first directional device to turn said mandrel, anchor, and whipstock and face said whipstock in said predetermined direction, said anchor means having coupling means thereon engaging said anchor to secure said anchor means to said anchor and prevent movement of said whipstock in the well bore to retain said whipstock facing in said predetermined direction.

2. Apparatus as defined in claim 1; said anchor having a passage in which said first device is located, said mandrel being movable downwardly in said passage to align said second directional device with said first directional device.

3. Apparatus as defined in claim 1; one of said devices including a projection, the other of said devices having a longitudinal groove receiving said projection to retain said whipstock facing in said predetermined direction.

4. Apparatus as defined in claim 2; one of said devices including a projection, the other of said devices having a longitudinal groove receiving said projection to retain said whipstock facing in said predetermined direction.

5. Apparatus as defined in claim 2; said first device including a projection secured to said anchor and projecting into said passage, said second device having a longitudinal groove receiving said projection to retain said whipstock facing in said predetermined direction.

6. Apparatus as defined in claim 1; said anchor securing means including normally retracted slips on said anchor, and a setting tool secured to said anchor to expand said slips into anchoring engagement with the wall of the bore.

7. Apparatus as defined in claim 6; said anchor having a passage in which said first device is located, said mandrel being movable downwardly in said passage to align said second directional device with said first device, said first device including a projection secured to said anchor and projecting into said passage, said second device having a longitudinal groove receiving said projection to retain said whipstock facing in said predetermined direction.

8. Apparatus as defined in claim 1; said anchor having an upper threaded member, said coupling means comprising a threaded latch movable downwardly along said upper threaded member and into latching engagement with said upper threaded member.

9. Apparatus as defined in claim 8; said anchor having a passage in which said first device is located, said mandrel being movable downwardly in said passage to align said second directional device with said first device, said first device including a projection secured to said anchor and projecting into said passage, said second device having a longitudinal groove receiving said projection to retain said whipstock facing in said predetermined direction.

10. Apparatus as defined in claim 8; said anchor securing means including normally retracted slips on said anchor and a setting tool secured to said anchor to expand said slips into anchoring engagement with the wall of the well bore, said setting tool being removed from said anchor and well bore prior to lowering said whipstock in the well bore and securing said anchor means to said anchor, said anchor having a passage in which said first device is located, said mandrel being movable downwardly in said passage to align said second directional device with said first device, said first device including a projection secured to said anchor and projecting into said passage, said second device having a longitudinal groove receiving said projection to retain said whipstock facing in said predetermined direction.

11. Apparatus as defined in claim 1; in which said anchor includes packing means to seal against a companion wall in the well bore.

12. Apparatus as defined in claim 1; means for turning said anchor to locate said first directional device in said predetermined direction so that the angular relation between said first device and predetermined direction is substantially zero degrees.

13. Apparatus as defined in claim 12; in which said anchor includes packing means to seal against a companion wall in the well bore.

14. Apparatus for securing a whipstock in a well bore, comprising an anchor, means for securing said anchor in the well bore, a whipstock, anchor means secured to said whipstock and having coupling means thereon engageable with said anchor to secure said anchor means to said anchor and permanently prevent upward movement of said whipstock in the well bore, said anchor securing means including normally retracted slips on said anchor, and a setting tool removably secured to said anchor to expand said slips into anchoring engagement with the wall of the well bore, said setting tool being removed from said anchor and well bore prior to lowering said whipstock in the well bore and securing said anchor means to said anchor.

15. Apparatus as defined in claim 14; said anchor having an upper threaded member, said coupling means comprising a threaded latch movable downwardly along said upper threaded member and into latching engagement with said upper threaded member.

16. Apparatus for securing a whipstock in a well bore, comprising an anchor, means for securing said anchor in the well bore, a whipstock, anchor means secured to said whipstock and having coupling means thereon engageable with said anchor to secure said anchor means to said anchor and permanently prevent upward movement of said whipstock in the well bore, said anchor having an upper threaded member, said coupling means comprising a threaded latch movable downwardly along said upper threaded member and into latching engagement with said upper threaded member.

17. A method of securing a whipstock in a well bore with the whipstock facing in a desired direction, comprising lowering an anchor having a first directional device into the bore hole to a desired setting depth and determining the angular relation between said device and said desired direction, then setting the anchor in the well bore with the first directional device having the same angular relation to said desired direction, lowering into the well bore a whipstock secured to an anchor means operatively connected to a mandrel having a second directional device having the same angular relation to the whipstock as said first directional device bears to said desired direction, engaging said second directional device with said first device to turn the mandrel, anchor, and whipstock to face the whipstock in said desired direction, and coupling the anchor means with respect to the anchor to retain the whipstock facing in said desired direction.

18. A method as defined in claim 17; taking a survey of the direction in which the first directional device is oriented to determine the angular relation between said device and said desired direction, turning the anchor to face the first directional device in the desired direction so that the angular relation between said first device and desired direction is substantially zero degrees.

19. A method as defined in claim 17; the anchor being set by a setting assembly releasably secured to the anchor, and releasing the setting assembly from the set anchor and withdrawing the assembly from the well bore before the whipstock, anchor means, and mandrel are lowered in the well bore.

20. A method as defined in claim 17; an orienting sub being disposed above the setting assembly aligned rotationally with the first directional device, taking a survey with a survey instrument disposed in said orienting sub to determine the direction in which the first directional device is oriented to determine the angular relation between said device and said desired direction, turning the anchor to face the first directional device in the desired direction so that the angular relation between said first device and desired direction is substantially zero degrees.

* * * * *